US010441040B2

(12) United States Patent
Frost

(10) Patent No.: US 10,441,040 B2
(45) Date of Patent: Oct. 15, 2019

(54) UMBRELLA, UMBRELLA FRAME AND RIB THEREFOR

(71) Applicant: Hubert Samuel Frost, Toronto (CA)

(72) Inventor: Hubert Samuel Frost, Toronto (CA)

( * ) Notice: Subject to any disclaimer, the term of this patent is extended or adjusted under 35 U.S.C. 154(b) by 0 days.

(21) Appl. No.: 15/095,731

(22) Filed: Apr. 11, 2016

(65) Prior Publication Data

US 2016/0219994 A1 Aug. 4, 2016

Related U.S. Application Data

(63) Continuation-in-part of application No. 13/263,290, filed as application No. PCT/CA2010/000522 on Apr. 7, 2010.

(60) Provisional application No. 61/167,382, filed on Apr. 7, 2009.

(51) Int. Cl.
*A45B 25/02* (2006.01)
*A45B 19/00* (2006.01)

(52) U.S. Cl.
CPC ..... *A45B 25/02* (2013.01); *A45B 19/00* (2013.01); *A45B 2019/001* (2013.01)

(58) Field of Classification Search
CPC ..... A45B 19/10; A45B 25/02
USPC ..... 135/20.3, 26, 33.5, 25.33
See application file for complete search history.

(56) References Cited

U.S. PATENT DOCUMENTS 2,072,254 A * 3/1937 Evans ..... A45B 25/02 135/31
2,531,735 A * 11/1950 Jones ..... A45B 25/18 135/33.41
2,816,560 A * 12/1957 Wuster ..... A45B 25/006 135/23
5,305,771 A * 4/1994 Wilk ..... A45B 25/18 135/31
5,394,896 A * 3/1995 Wilk ..... A45B 25/18 135/31
5,842,493 A * 12/1998 Yakubisin ..... A45B 25/22 135/29
6,053,188 A * 4/2000 Walker ..... A45B 25/02 135/26
7,913,709 B2 * 3/2011 Brebner ..... A45B 19/06 135/31

FOREIGN PATENT DOCUMENTS

WO WO 2005048765 A1 * 6/2005 ..... A45B 19/06

* cited by examiner

*Primary Examiner* — Noah Chandler Hawk
(74) *Attorney, Agent, or Firm* — Bereskin & Parr LLP/S.E.N.C.R.L., s.r.l.

(57) ABSTRACT

An umbrella has a canopy, a main shaft and a plurality of ribs pivotally attached to the main shaft, each rib being of adjustable length and including a pair of outer rib elements, wherein the outer rib elements are flexible and normally adopt a straight configuration aligned with the main shaft in a closed position of the umbrella, and in an open position of the umbrella, flex so that outer ends of the outer rib elements extend generally circumferentially with respect to the canopy. The umbrella can have ribs that would normally be of one piece, in which case accommodation is made for an effective change in the radius of the ribs as the outer rib elements flex. The umbrella may be a folding umbrella with two part ribs. The outer ribs can have a non-uniform cross-section and may taper.

9 Claims, 19 Drawing Sheets

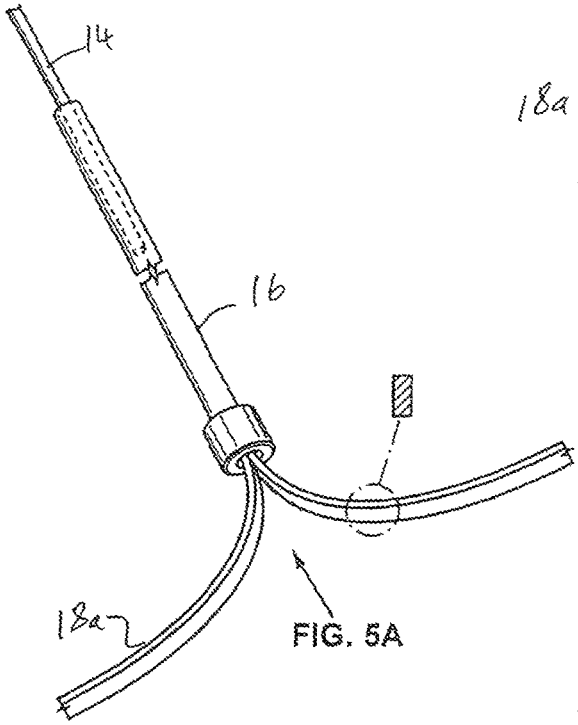
FIG. 5A
FIG. 5
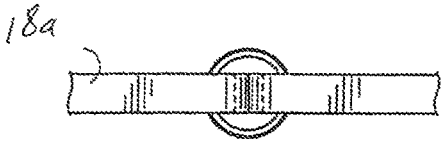
FIG. 5B
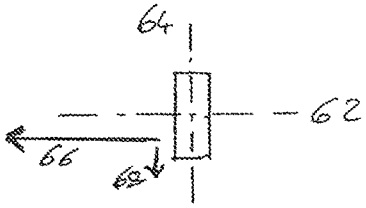
FIG 5C
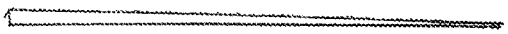
FIG 5F
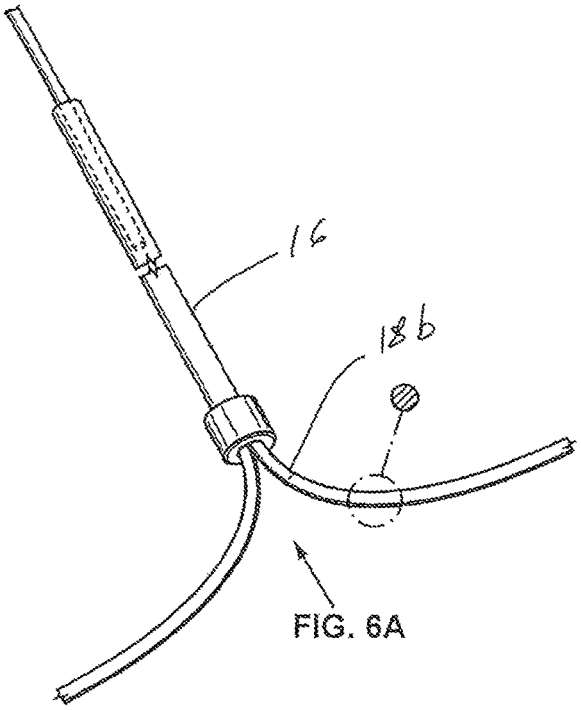
FIG. 6A
FIG. 6
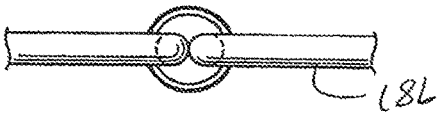
FIG. 6B

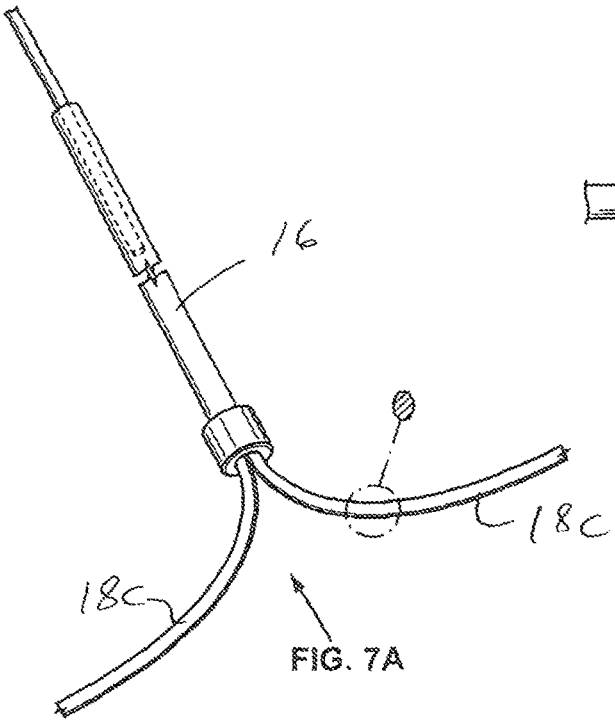
FIG. 7A
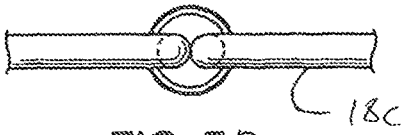
FIG. 7B
FIG. 7
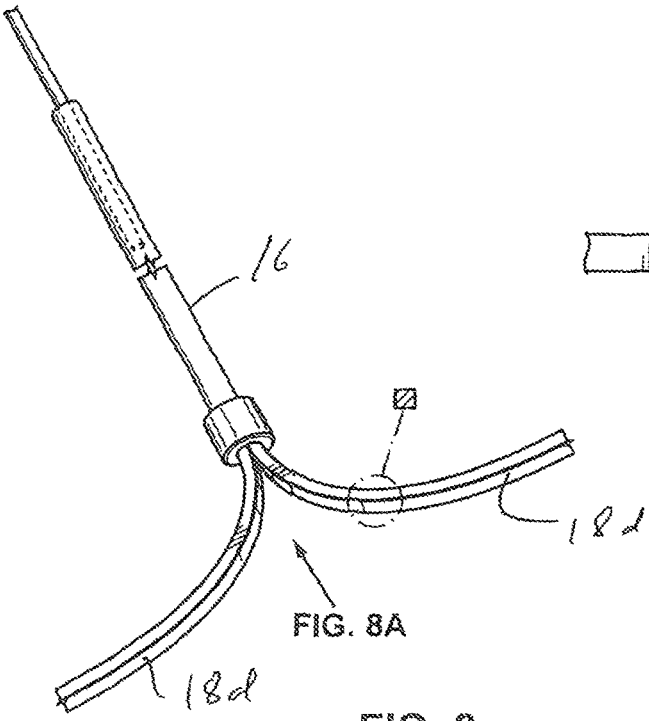
FIG. 8A
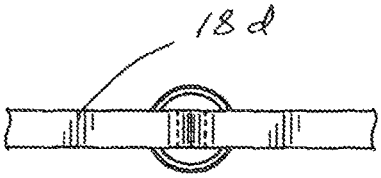
FIG. 8B
FIG. 8

UMBRELLA, UMBRELLA FRAME AND RIB THEREFOR

CROSS-REFERENCE TO RELATED APPLICATION

This application is a Continuation of application Ser. No. 13/263,290, filed Oct. 6, 2011.

FIELD

This invention relates to an umbrella, an umbrella frame and a rib for an umbrella, and is applicable to all types of umbrellas, parasols and the like, including collapsible and non-collapsible variants.

BACKGROUND

The following paragraphs are not an admission that anything discussed in them is prior art or part of the knowledge of persons skilled in the art.

There are known a number of umbrella designs. These are used to protect a user from rain, sun and and/or wind. A conventional umbrella has a rigid central shaft and a plurality of ribs or spokes attached to the top of the central shaft. Supporting struts or connecting ribs connect the ribs or spokes to a slider on the central shaft. The frame of the umbrella is thus movable between open and closed configurations, but each rib or spoke is of fixed dimensions, and is usually of one piece construction.

Other umbrella designs are described as compact or multiple fold, and sometimes as collapsible. They have ribs that have a number of elements pivotally connected together, and usually the central shaft has two or more elements that telescope together, so that when collapsed or folded, the umbrella is smaller and more compact.

For all these known umbrella designs, the ends of the ribs are generally perpendicular to the periphery of the canopy and are exposed. Even if the ribs are rounded or otherwise provided with protective elements, they still can be a nuisance to others and a danger to people's eyes.

U.S. Pat. Nos. 5,394,896 and 5,305,771 to Peter Wilk disclose a frame for an umbrella that has ends of the ribs connected together by curved elements, intended to eliminate the problem of the tips of the ribs protruding beyond the canopy. However, this patent fails to recognize that in a collapsed or folded configuration, the effective radius of the ribs is increased beyond the effective radius in the open configuration. This proposal does not have the edge or periphery of the canopy attached to the frame at any point.

A more recent proposal is disclosed in published PCT application WO 2005/048765. It provides a complex arrangement, in which the ribs have rods sliding within tubes, to actuate force spreading compartments at the end is of the ribs.

SUMMARY

The following introduction is intended to introduce the reader to this specification but not to define any invention. One or more inventions may reside in a combination or sub-combination of the apparatus elements or method steps described below or in other parts of this document. The inventor does not waive or disclaim his rights to any invention or inventions disclosed in this specification merely by not describing such other invention or inventions in the claims.

In accordance with a one aspect of the present invention there is provided a frame for an umbrella for supporting a canopy, the frame comprising: a main shaft; a plurality of ribs connected to the main shaft, each rib including a pair of outer rib elements, with an outer end of the each outer rib element being connected to the free end of the outer rib element of an adjacent rib, and being adapted to be attached to the periphery of the umbrella canopy.

In accordance with a another aspect of the present invention, there is provided frame for an umbrella, the frame comprising a main shaft, a plurality of ribs pivotally connected to the main shaft, each rib being of adjustable length, and each rib including a pair of outer rib elements, that are flexible, whereby in use, the outer rib elements in a closed configuration, extend generally straight and aligned with the main shaft, and in an open configuration, are flexed so that outer ends thereof extends generally circumferentially.

In accordance with a another aspect of the present invention, there is provided A foldable umbrella comprising: a canopy, a main shaft; a plurality of ribs pivotally attached to the main shaft, each rib comprising at least two rib elements pivotally attached to one another, to enable the umbrella to fold to a compact closed configuration, and each rib further including a pair of outer rib elements, that extend generally straight and aligned with the main shaft in the closed configuration, and in an open configuration have outer ends extending generally circumferentially with respect to the canopy.

In accordance with a further aspect of the present invention, there is provided umbrella comprising: a canopy; a main shaft; a plurality of ribs pivotally attached to the main shaft, each rib being of adjustable length and including a pair of outer rib elements, wherein the outer rib elements are flexible and normally adopt a straight configuration aligned with the main shaft in a closed position of the umbrella, and in an open position of the umbrella, flex so that outer ends of the outer rib elements extend generally circumferentially with respect to the canopy.

The present invention also provides a rib structure for an umbrella or the like, comprising an inner rib element, and a pair of outer rib elements, that are flexible, for adopting a straight configuration in a closed configuration of an umbrella and being capable of flexing for an open position of an umbrella.

BRIEF DESCRIPTION OF THE DRAWINGS

For a better understanding of the present invention and to show more clearly how it may be carried into effect, reference will now be made, by way of example, to the accompanying drawings which show, by way of example, the present invention and in which:

FIGS. 5A, 5B, 5C, 5D, 5E and 5F; 6A and 6B, 7A and 7B; 8A and 8B and 9A, 9B, 9C and 9D show variants of outer rib elements;

DETAILED DESCRIPTION

Figure 1:
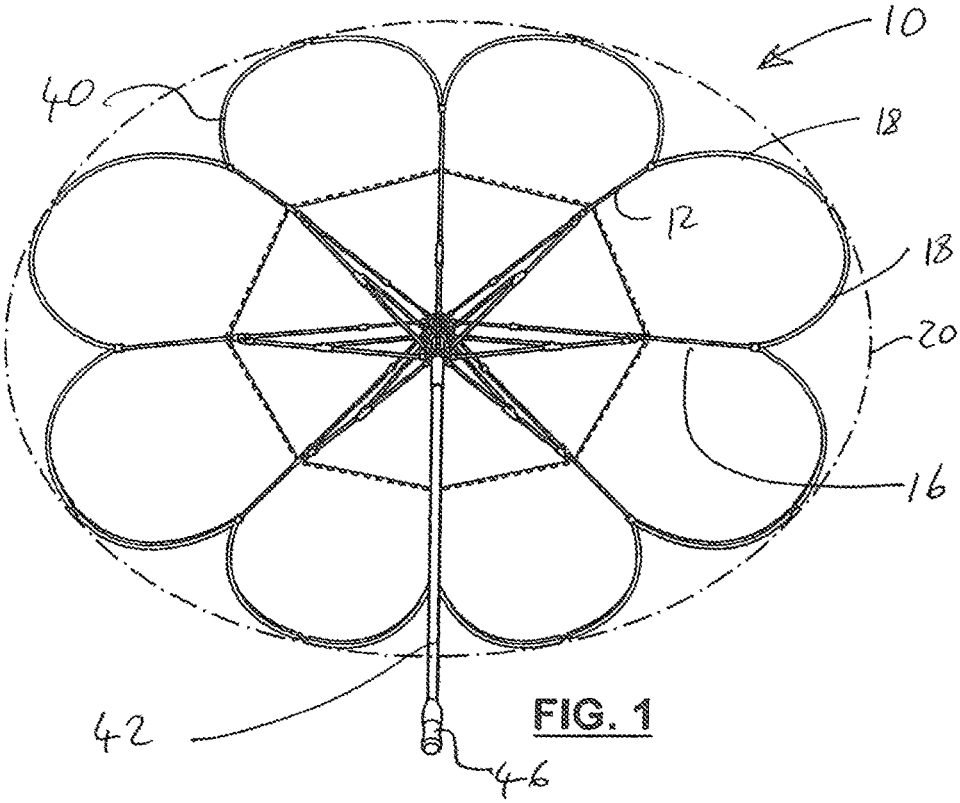
FIG. 1 is a perspective view of a first embodiment of an umbrella according to the present invention, in an open configuration.

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. It is possible that an apparatus or method described below is not an embodiment of any claimed invention. The applicants, inventors and owners reserve all rights in any invention disclosed in an apparatus or method described below that is not claimed in this document and do not abandon, disclaim or dedicate to the public any such invention by its disclosure in this document.

Reference will first be made to FIGS. 1-4 of the drawings, which show a first embodiment of the present invention. This first embodiment is designated by the reference 10, and is shown with a frame 40 having eight equally spaced ribs 12. The number of ribs may be varied, and for example, the umbrella 10 could have ten, twelve, fourteen, sixteen, eighteen, twenty or more ribs, including an odd number of ribs; it is also conceivable that the umbrella 10 may have less than eight ribs. As detailed below, the umbrella of the present invention has outer rib elements, that are straight in a closed configuration, but flex and are curved in a closed configuration; consequently, the effective radius or length of the ribs in the closed configuration is increased compared to their length in the open configuration. The smaller the number of ribs, the greater is this effect.

The first embodiment of FIGS. 1-4 is for an umbrella at 10 that would otherwise have ribs 12 that are of constant length. This first embodiment provides ribs 12 of variable or adjustable length, to accommodate this effect of the varying of the effective radius of the outer rib elements. A second embodiment, described below in relation to FIGS. 12A-12E, provides a folding, or collapsible rib structure. It has been realized that when such an umbrella frame is folded or collapsed it inherently provides slack in the canopy, they can be used to accommodate the effective increase in length of the ribs 12.

It is also to be understood that while the present invention is described in relation to umbrellas for individual use, it is applicable to any type of umbrella, parasol, sunshade, or similar canopy. It is applicable to umbrellas of any size, including beach umbrellas, golf umbrellas, patio umbrellas, etc. Further, it is applicable to asymmetric umbrellas having ribs of different lengths. For example as disclosed in published PCT application WO2006/132525.

Each rib 12 has an inner rib element 14 and a middle rib element 16, that are slidably connected. As shown, the inner rib element 14 may be a rod, and the middle rib element 16 may be a tube. It may be preferable to reverse this arrangement, with the inner rib element 14 configured as a tube, and the middle rib element 16 configured as a rod. Any other suitable sliding arrangement can be used.

The middle rib element 16 is connected to a pair of outer rib elements 18. As detailed below, the outer end of each rib element 16 is either connected to the outer end of a rib element of an adjacent rib 12, or is connected to a canopy 20 of the umbrella term, so as to be maintained close to or adjacent the outer end of the rib element of the adjacent rib 12. In some embodiments, in the open configuration the ends of the outer rib elements 18 of adjacent ribs 12 may be spaced apart. A variety of arrangements can be provided for the outer ends of the outer rib elements 18, as detailed below.

Each rib 12 has a primary support, rib 22, pivotally connected to its middle rib element 16 at 24, and to a first slider 26. A secondary support rib 28 is pivotally connected to the primary support rib 22 at 30, and to a second slider 32.

In known manner, locking mechanisms can be provided for holding the umbrella frame, indicated generally by the reference 38, at desired positions. Such mechanisms can include spring loaded protrusions extending out through slots in the main shaft 42.

Figure 2:
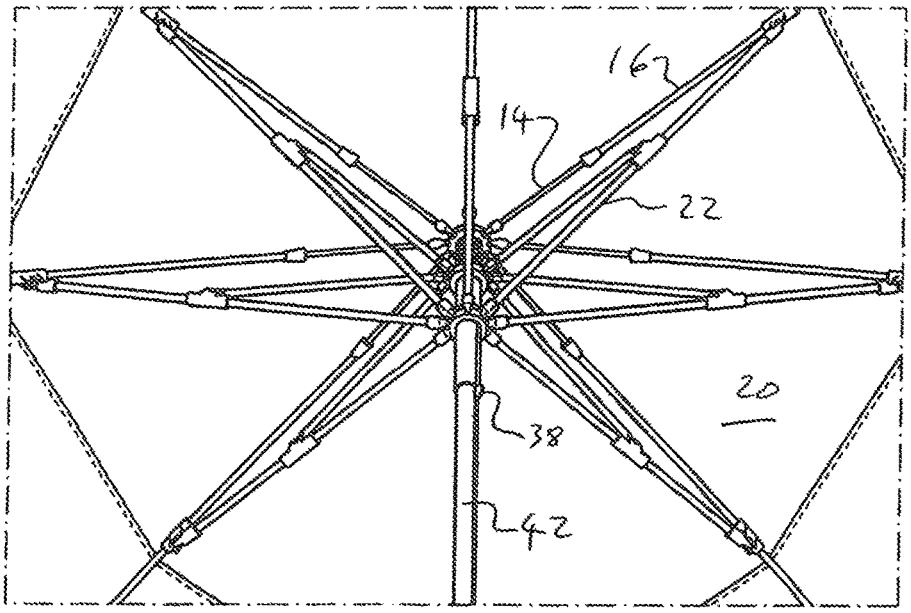
FIG. 2 is a perspective view, similar to FIG. 1, on an expanded scale.

FIGS. 1 and 2 show the umbrella 10 and its frame 40 in a generally open configuration. Reference will now be made to FIGS. 3A-3D and to FIGS. 4A-4E. which show the frame 40 as it is progressively opened.

Figure 3A:
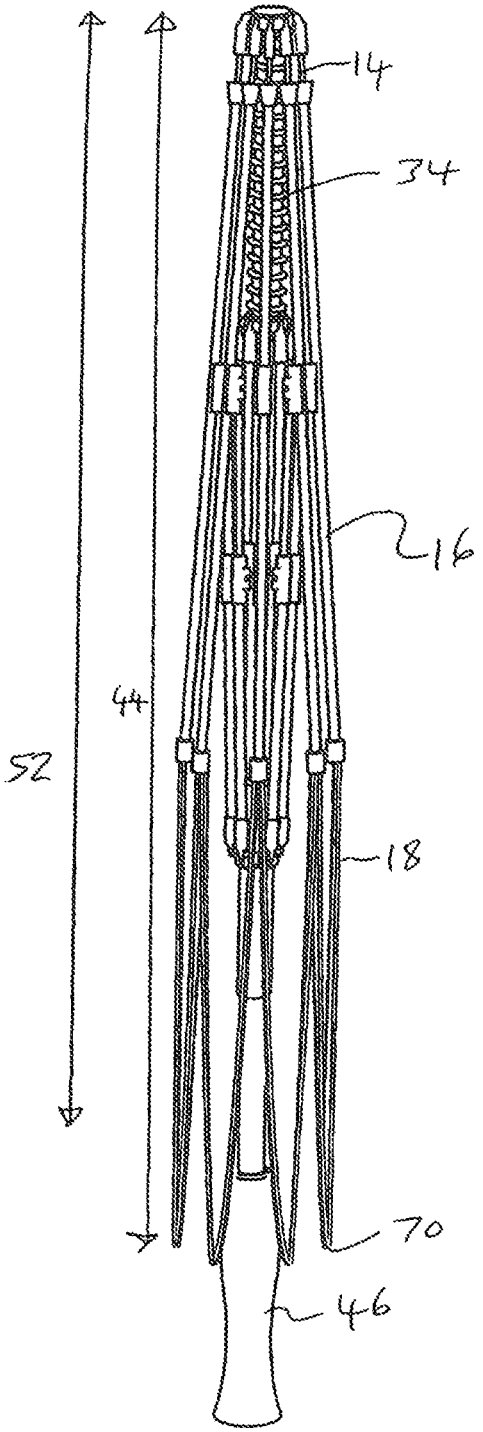
FIG. 3A is a view of the first embodiment of the umbrella in a closed configuration.

In FIG. 3A, the frame 40 is shown in a closed position, with the ribs 12 close to the main shaft 42. As shown, the outer rib elements 12 extend generally downwardly and parallel to one another. The effect of this is to give an overall effective radius for the ribs 12 as indicated at 44. To initiate opening of the umbrella term, a user grasps a handle 46 at the bottom of the main shaft 42, and the first slider 26. In known manner, the user may first have to release a locking member or catch, used to retain the first slider 26 and thus the frame 40 generally in the closed configuration.

Figure 3B:
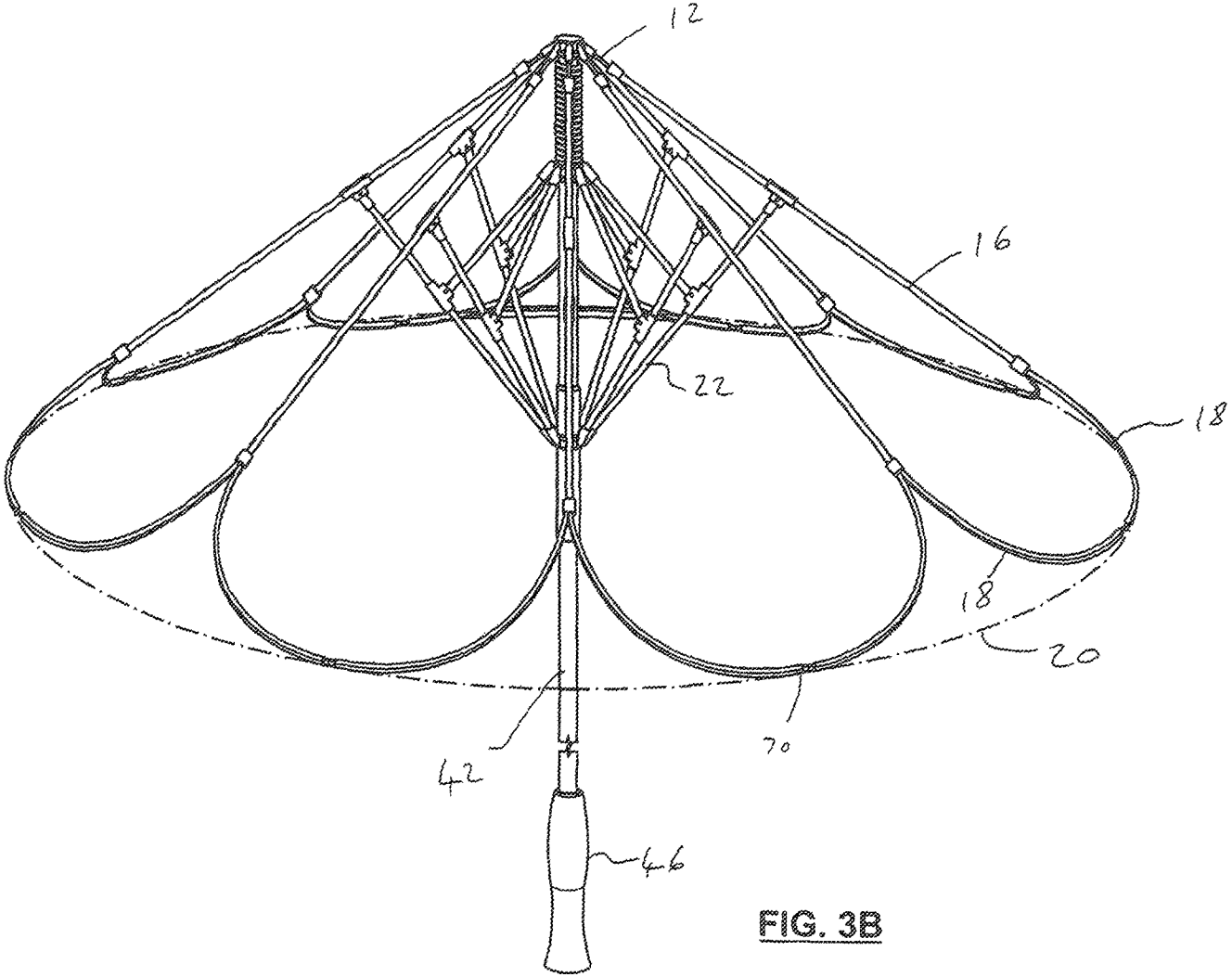
FIGS. 3B-3D are perspectives view of the first embodiment showing progressive opening of the umbrella.
Figure 3C:
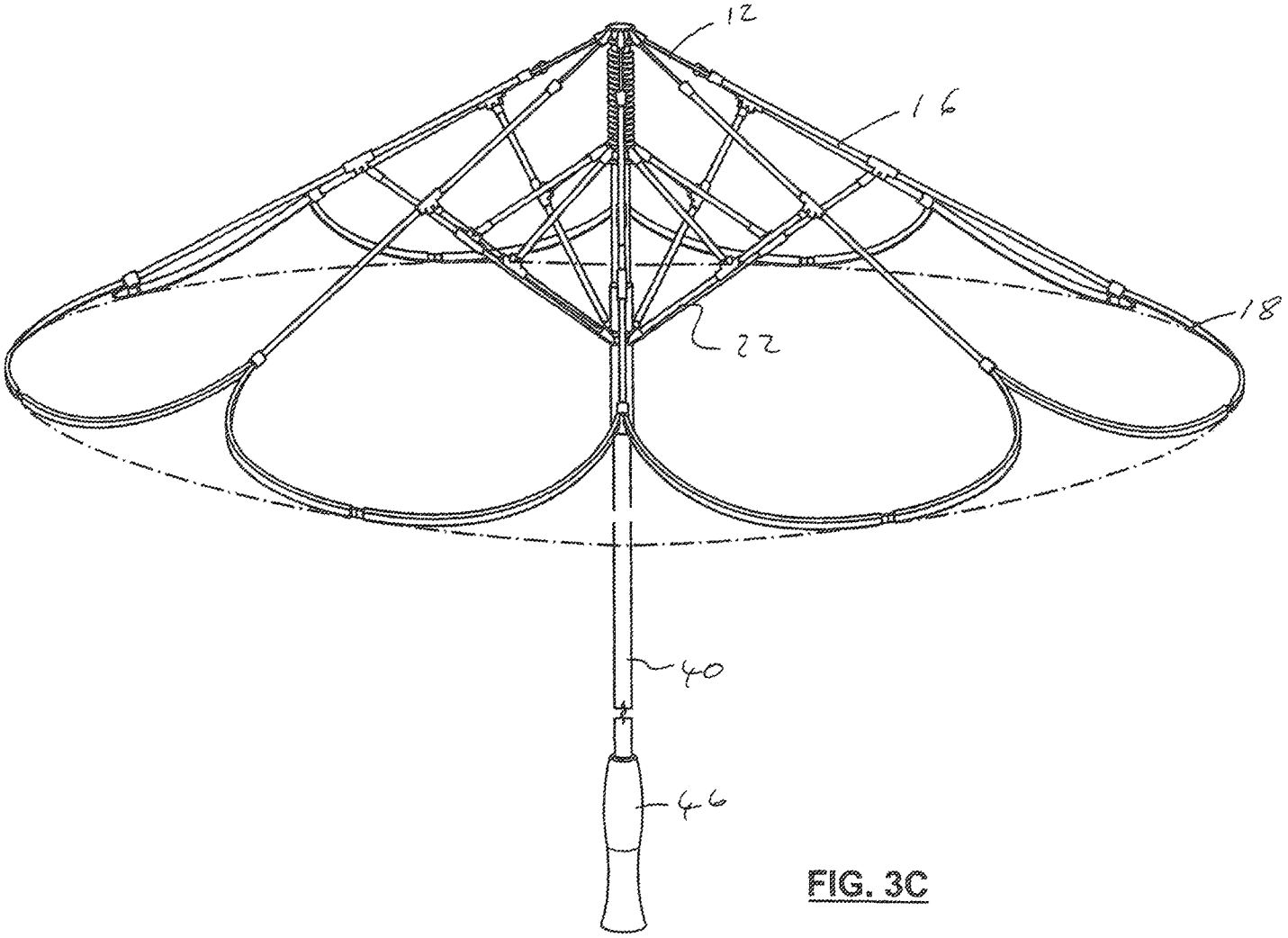

As the first slider 26 is displaced upwardly along the shaft 42, the ribs 12 are displaced outwardly as shown in FIG. 3B. Simultaneously, The primary support Ribs 22 and their connection 24 to the middle rib elements 16 are displaced outwardly. In turn, the connections 30 for the secondary support ribs 28 are displaced radially outwards away from the main shaft 42. Consequently, while the second slider 32 is displaced upwards along the main shaft 42, the first and second sliders 26, 32 move closer together.

The spring 34 functions to resist upward movement of the second slider 32. To ensure that too greater force is not required to open the umbrella 10, it may be desirable to give the spring 34 a low spring constant. The resistance to movement of the second slider 32 by the spring 34 promotes displacement of the connections 30 outwards. In turn, this causes the middle rib elements 16 to slide along the inner rib elements 14, tending to expand the length of the ribs 12.

It may be desirable to ensure that this sliding motion of the middle elements 16 occurs before the frame 40 reaches or is close to the open configuration. As the frame 40 reaches the open configuration, the ribs 12 are flexed, and this may make sliding motion between the inner and middle rib elements 14, 16 more difficult and subject to more friction. Therefore, it may be preferable to ensure that all or most of this sliding action occurs before the ribs 12 are flexed and stressed by the canopy 20. But this purpose, as detailed in published PCT application WO 2005/048765, a mechanism may be provided that halts the motion of the second slider 32 at a certain point, so that continued motion of the first slider 26 causes the middle rib elements 16 to slide radially outwards to the maximum desired extent. Further motion of the first slider 26 then releases the second slider 32 permitting both slider elements 26, 32 to reach a final open configurations shown in FIG. 3D. For this purpose, the first slider 26 has a lower collar 26*a* and an upper collar 26*b*; the lower collar 26*a* is for gripping by a user, while the upper collar 26*b* abuts the second slider 32, to effect the action detailed above.

Figure 3D:
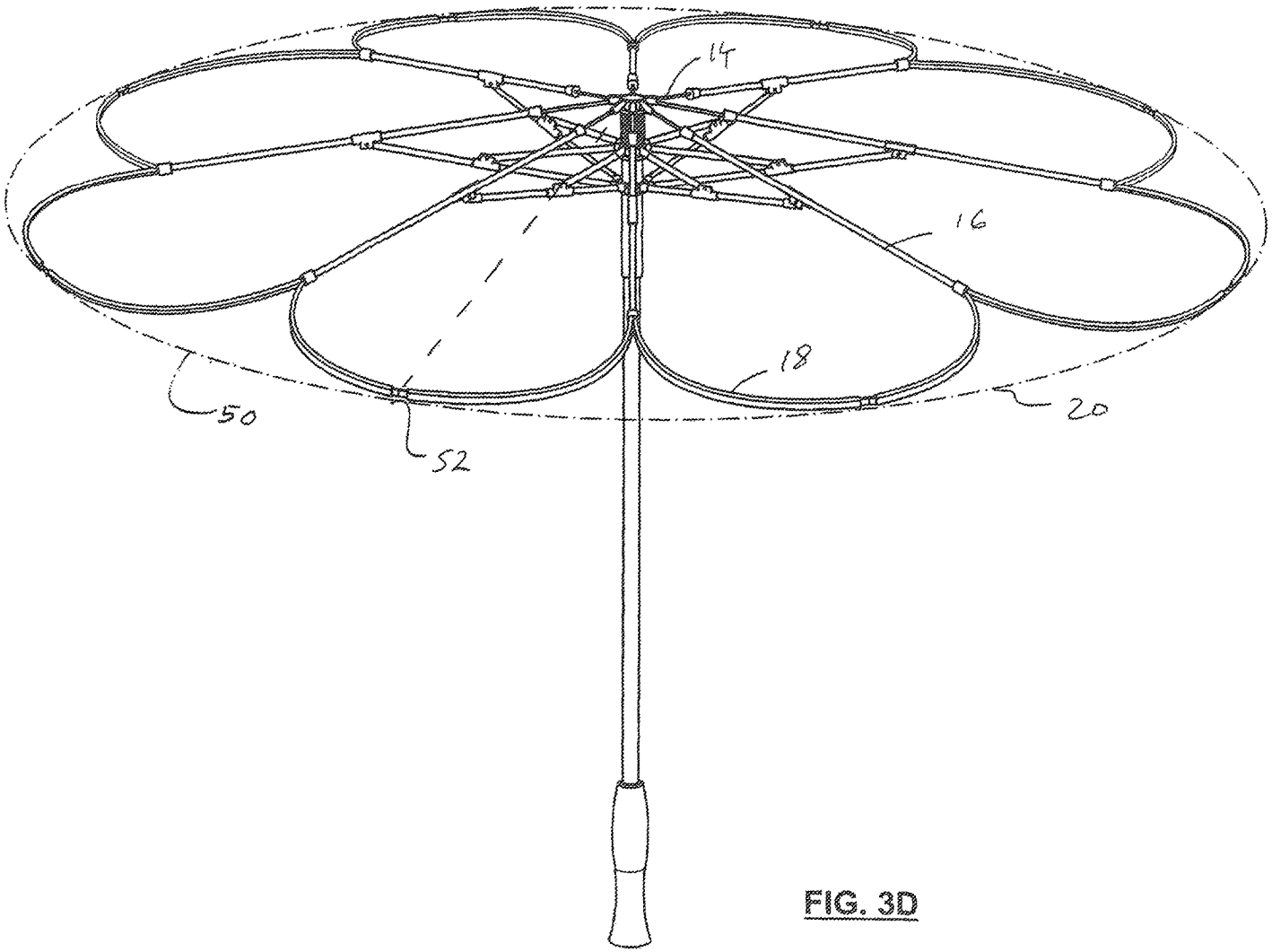

FIG. 3D shows the frame 40 in the fully open position. The canopy 20 is indicated in outline at 50. It has an effective radius at 52, which as shown also at 52 in FIG. 3A is less than the effective radius that the ribs 12 have in the closed position, indicated at 44.

Figure 4A:
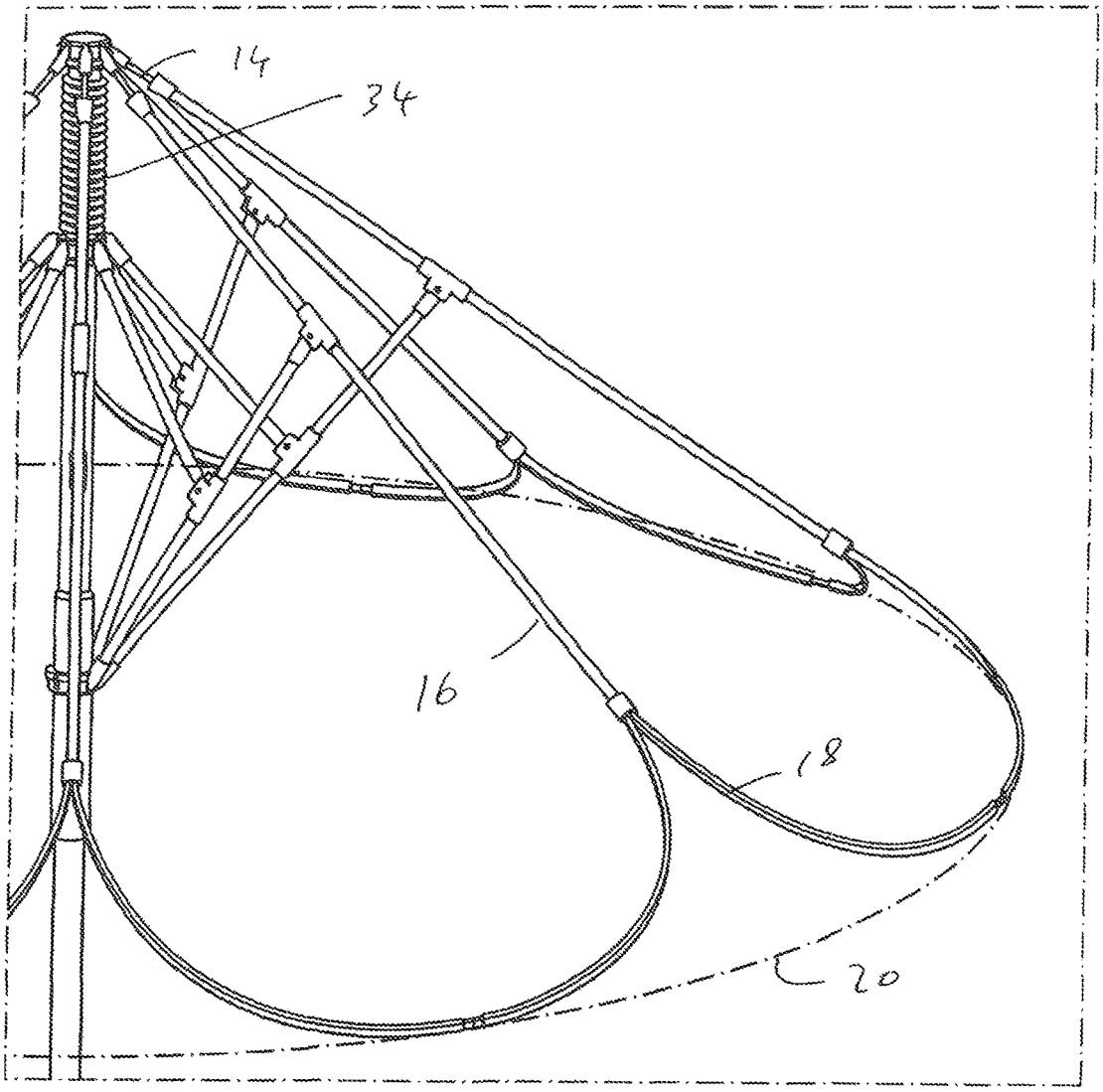
FIGS. 4A and 4B are perspective views of the first embodiment.
Figure 4B:
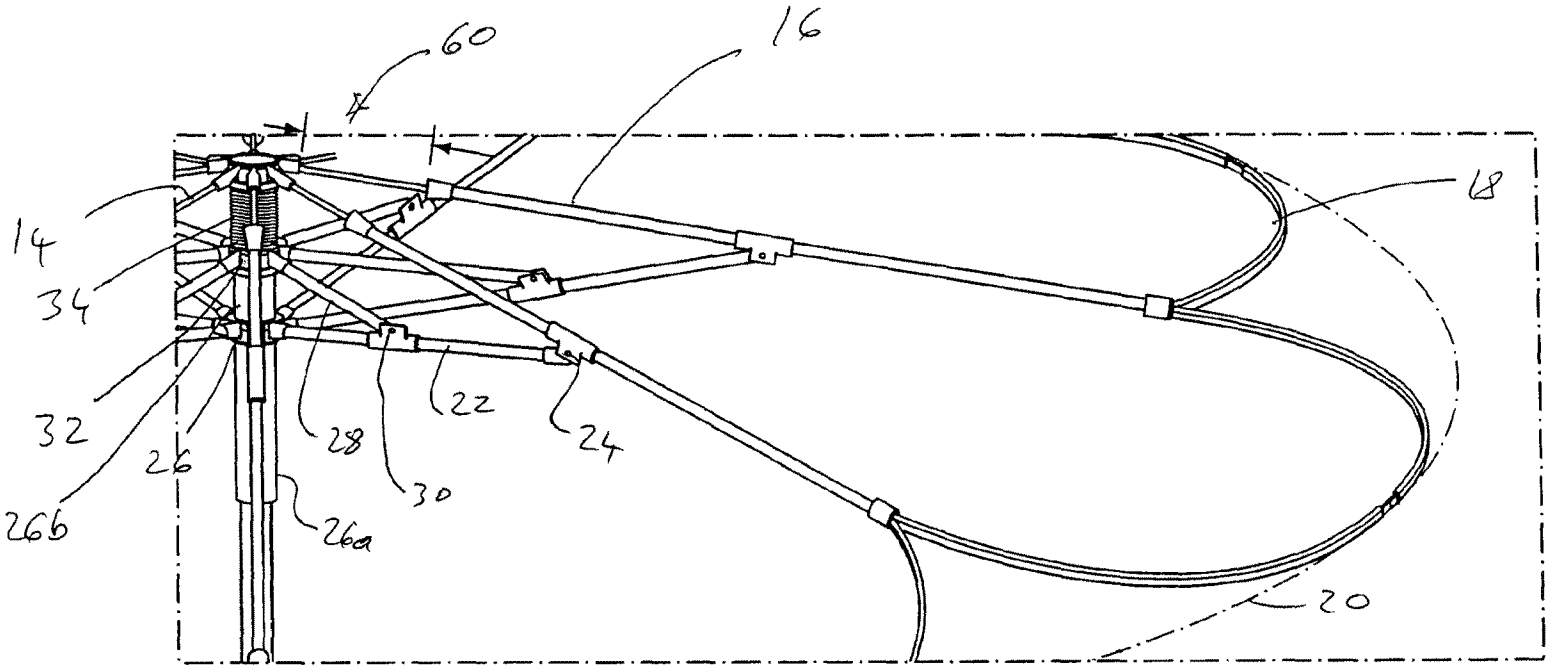
Figure 4C:
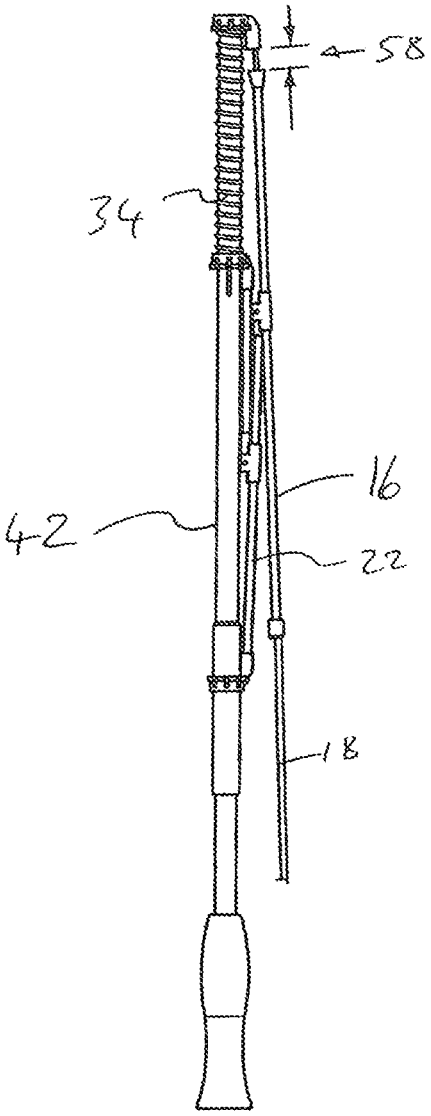
FIG. 4C is a view of part of the frame of the first embodiment in a closed position.
Figure 4D:
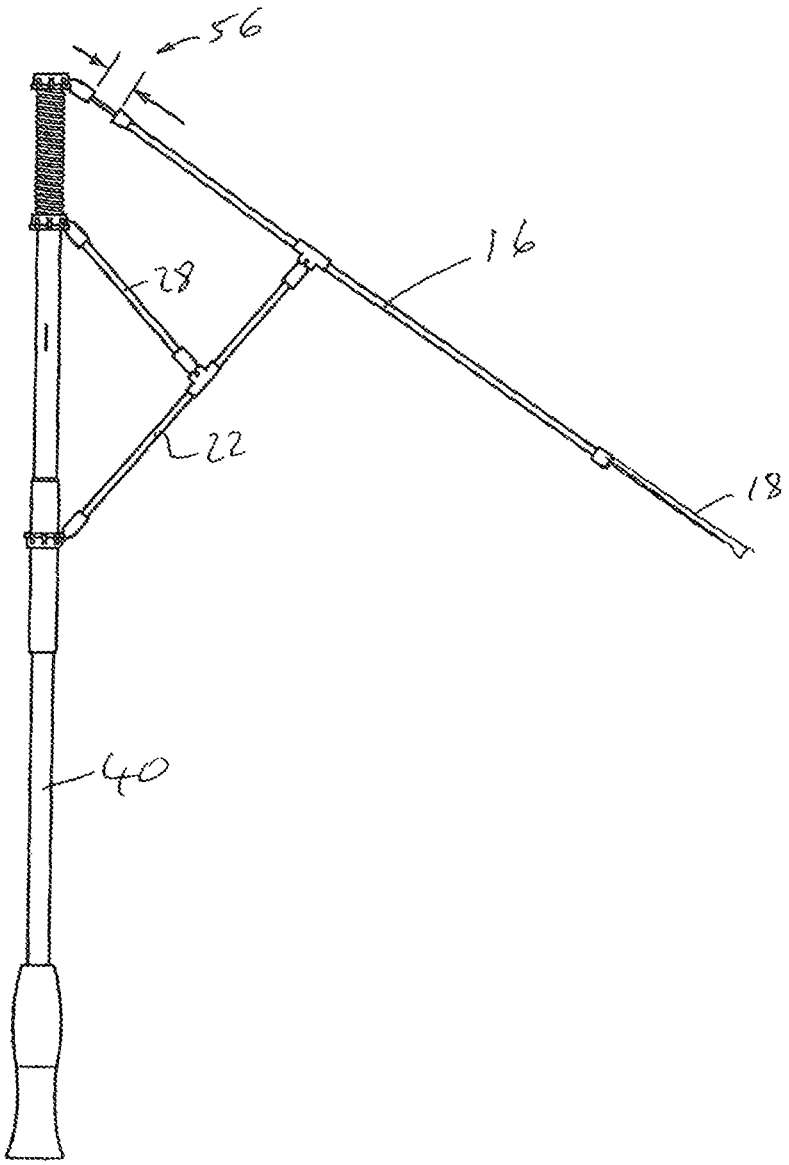
FIG. 4D and FIG. 4E show the frame moving to the open position.
Figure 4E:
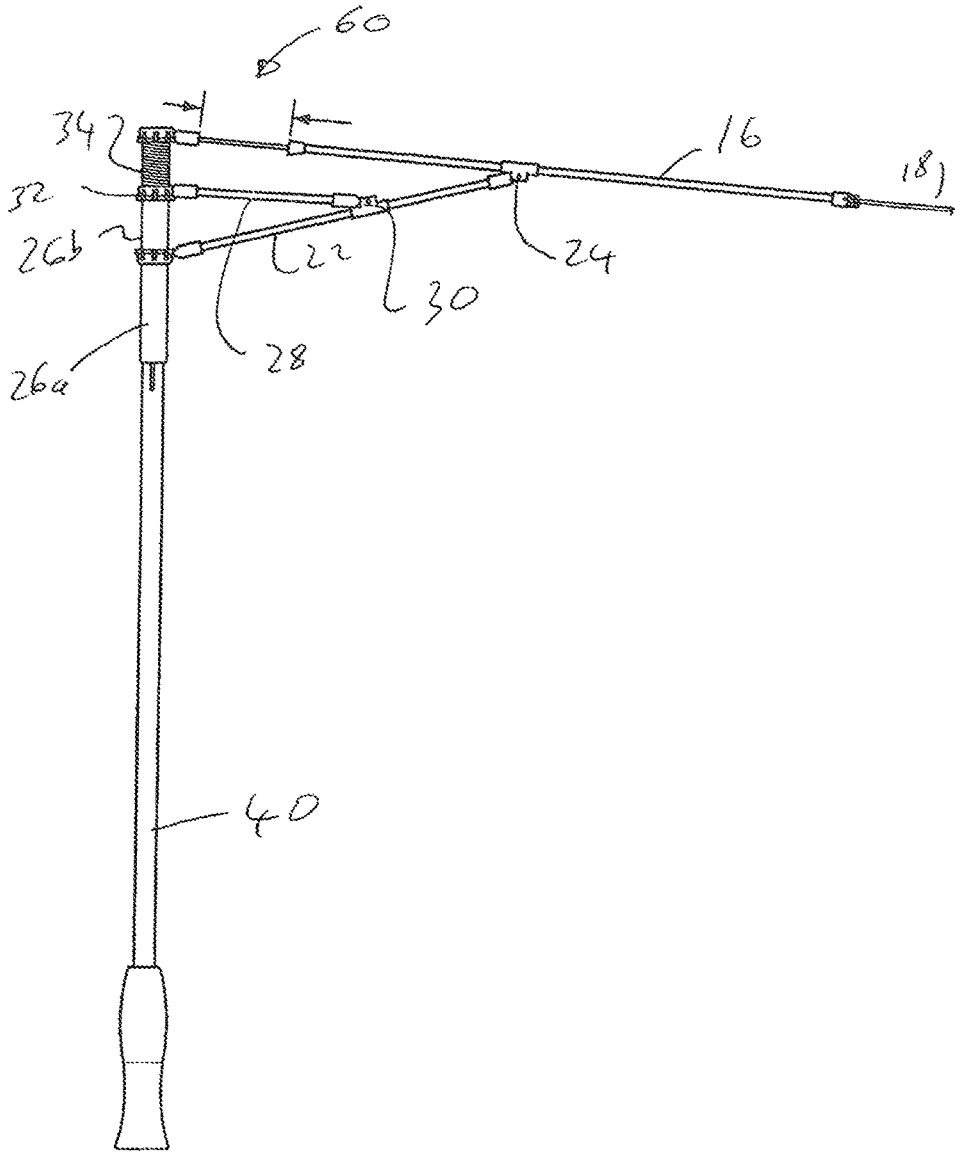

FIGS. 4A-4E also show the effect of the varying rib length. As indicated in FIGS. 4A and 4D, at the start of the opening of the umbrella, the middle rib elements 16 have only extended slightly along the rib elements 14, as indicated at 56. This is only slightly larger than the initial spacing, indicated at 58 in FIG. 40. When the umbrella is fully open, the middle rib elements 16 have slid further along the inner rib elements 14, so as to give a spacing indicated at 60. As mentioned above, the spacing is selected to accommodate the effective change in radius as the outer rib elements 18 bent from the straight configurations shown in FIGS. 3A and 4C, to the fully open configuration shown, for example, in FIGS. 3D and 4E.

This effective change in radius will depend on various factors, including the number of ribs 12, and characteristics of the outer rib elements 18. As detailed below, the outer rib elements 18 can have a number of different profiles or cross sections. Moreover, the outer rib elements 18 can have cross sections that vary along the length thereof, so as to give different bending characteristics at different points. A simple analysis assumes that, in the open configuration, a pair of adjacent and connected outer rib elements 18 form part of a circle, effectively slightly more than a semicircle, that is tangential with the middle rib elements 16; this analysis is further done just in two dimensions, and overlooks the more complex three-dimensional domed shape of an umbrella. On this analysis, the difference in radius between the open and close configurations, measured as a percentage of the radius in the open configuration is: 22.8% for 8 ribs; 18.6% for 10 ribs; and 14.9% for 12 ribs, and will be less for a larger number of ribs, e.g. 14, 16, 18 or 20 ribs.

Taking approximate sizes for the radius of conventional umbrellas of 76 cm (30 inches) for a golf umbrella, and 57 cm (22 ½ inches) for a compact folding or collapsible umbrella, one can calculate numerical values for the change in radius. For the golf umbrella, the values are: 17.3 cm for 8 ribs; 14.1 cm for 10 ribs; and 11.3 cm for 12 ribs. For the compact, folding umbrella, the values are: 13 cm for 8 ribs; 10.6 cm for 10 ribs; and 8.5 cm for 12 ribs. While the mechanism shown in FIGS. 1-4 is schematic, it will be understood that the relative proportions of the different elements can be varied to give the values indicated above for the golf umbrella; it will further be understood that this general principle applies to any umbrella that otherwise would have fixed for one piece ribs. As detailed below, for the folding or collapsible umbrella, dimensions can be chosen for the mechanism, so that it inherently accommodates the change in radius.

Reference will now be made to FIGS. 5-9, which show variants for the outer rib elements 18, here distinguished from one another by use of suffixes a, b, etc.

FIG. 5A shows a middle rib element 16, formed as a tube, slidably engaging an inner no element 14, shown in part as a rod. As noted above, alternatively the middle rib element 16 could slide within the inner rib element 14, with the tube and rod arrangement reversed, or with any other suitable sliding configuration. FIGS. 5A and 5B show outer rib elements 18*a* having a rectangular cross-section. In known manner, the second moment of area or the bending resistance is proportional to the width and the cube of the depth. Thus, if the depth is three times the width, then, as shown in FIG. 5C, the second moment of the area about axis 62 is nine times greater than that about axis 64. Arrows 66, 68 indicate schematically the larger bending deflection that will occur about the different axes for the same load or bending moment.

The profiles of the rib elements 18 may be selected to give desired bending characteristics and strength. To withstand wind loads, the outer rib elements 18 can be given significant depth in a direction generally perpendicular to the canopy 20 (recognizing, that the canopy 20 is not a simple plane surface, but rather a complex three-dimensional curved surface). This is shown in FIG. 5. Simultaneously, to permit flexing of the outer rib elements 18 and opening of the frame 40, without requiring undue force from a user, the outer rib elements 16 can be made relatively narrow in the horizontal direction of FIG. 5C, to give a lower bending resistance the profile of FIG. 5C shows these characteristics.

Further, the outer rib elements 18 may not have a constant cross-section. For example, the cross-section can be varied to vary the second moment of area or bending resistance about one or both of the axes shown in FIG. 5C. It may be desirable to maintain the bending resistance about axis 62 high and constant, to resist wind loads, while varying the bending resistance about the axis 64, to ensure that the outer rib elements 18 adopt a desire profile.

For example, the horizontal width (horizontal dimension in FIG. 5C) may taper from a large dimension at the inner end of each outer rim element 18 to a smaller dimension at the outer end thereof, so that the outer end portion is more flexible (as shown in FIG. 5F). The depth may be held constant or may also taper similarly from the inner end to the outer end. An analogy can be made with fishing rods the commonly taper from the handle to the end of the rod. It will be understood that even if the depth is held constant, tapering the width will affect both the second moments of area; however the second moment or area about the axis 64 (that affects deflection in the direction of arrow 66) will be affected more than the other second moment of area about axis 62.

FIGS. 6A and 6B show an alternative profile for the outer rib elements 18*b*, which is circular. Here, to give varying bending characteristics the diameter of the cross-section may be varied. Further, to vary the bending characteristics about the different axes, the cross-section can vary from circular at different points along the rib elements 18*b*.

FIGS. 7A and 7B show an elliptical cross-section for the outer rib elements 18*c*. Again, the dimensions of this cross-section can be varied to give desired bending characteristics along the length of the outer rib elements 18. The relative dimensions of the major and minor axes of the elliptical cross-section can be varied, to vary the bending characteristics about the different axes independently.

FIGS. 8A and 8B show a square cross-section for the outer rib elements 18. Again, this profile can be varied along the length of the outer rib elements 18, to give desired characteristics.

Figure 9D:
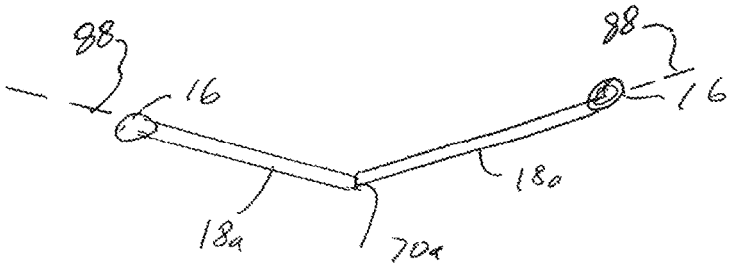
Figure 9A:
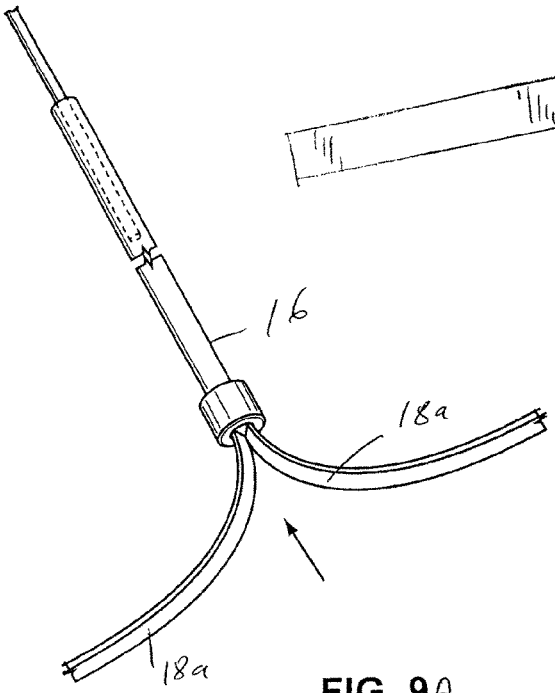
Figure 9B:
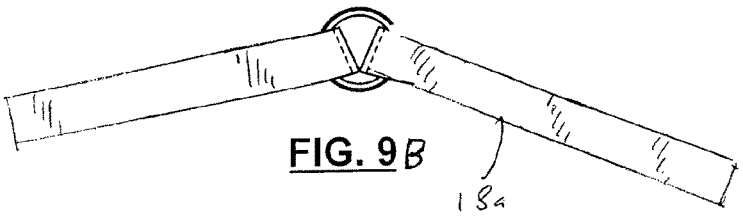
Figure 9C:
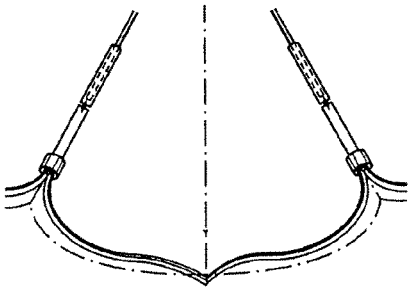

FIGS. 9A and 9B show a variant in which the outer rib elements 18*a*, as in FIG. 5C, have different second moments of area about two axes. Here, the outer rib elements 18*a* are secured to the middle rib element 16, so that their axes 88 are inclined at an angle relative to one another. As viewed in FIG. 9A, the axes 88 at an angle to the horizontal. This is used to control the shape of the canopy 20. As shown in FIG. 9D, a shallow V-shape appears when the canopy 20 is viewed generally along the top of the canopy, i.e. directly at the periphery of the canopy. As shown at 70*a*, outer ends 70 of the outer rib elements 18 meet at a shallow angle if the two moments of area about the axes 62, 64 are adjusted so that the rib elements can bend relatively easily in response to a small load in the direction of arrow 66, but are stiff in response in the direction of arrow 68, then it should be possible to achieve this shape with little deflection in the direction of arrow 68, i.e. generally perpendicularly to the canopy.

Figure 10:
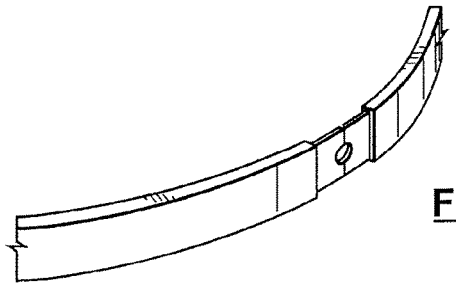
FIG. 10 shows a first variant of a joint between outer rib elements.

FIG. 10 shows one connection between outer ends 70 of the outer rib elements 18, in the form of a living hinge 72. The living hinge 72 may be integrally formed with or attached to the outer ends 70. Living hinge 72 includes an opening 74 to permit the hinge 72 to be attached by sewing to the edge of the canopy 20.

Figure 11A:
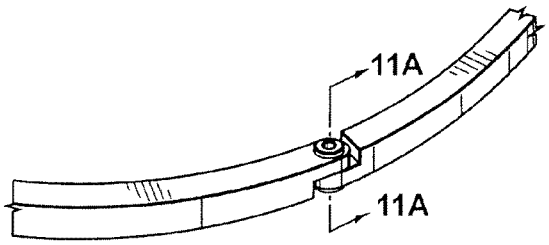
FIG. 11A and FIG. 11B show a second variant of a joint between outer rib elements.
Figure 11B:
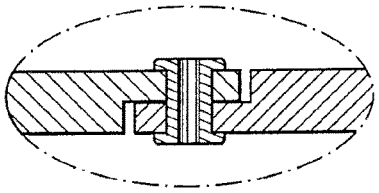

FIG. 11A and 11B show a pivot or hinge 76, including a pivot element 78, that can be in the form of a rivet. As shown in FIG. 11B, the ends up the outer rib elements 18, here indicated at 70*b* can be shaped to overlap and provide a constant thickness at the hinge 76. By providing an opening 79 through the pivot element 78, the hinge 76 may be attached to the periphery of the canopy by sewing. The pivot element may be strong enough to transmit bending loads between the ends 70, so as to maintain them aligned in a torsional sense, ie with respect to torsional loads about an axis that is horizontal and in the plane of FIG. 11B, and also in response to bending loads about an axis perpendicular to the plane of FIG. 11B. The pivot connection can also limit the angular extent of the opening of the ends 70, to that shown in FIG. 11.

It will also be understood that various other mounting and connection arrangements can be provided for the ends 70 of the outer rib elements 18. Instead of adjacent ends 70 being connected together, each end 70 could be connected, e.g. by sewing in known manner, to the periphery of the canopy 20, and may be spaced from one another. Another alternative is to provide pockets in the canopy to receive the ends 70 of the rib elements 18.

Figure 5D:
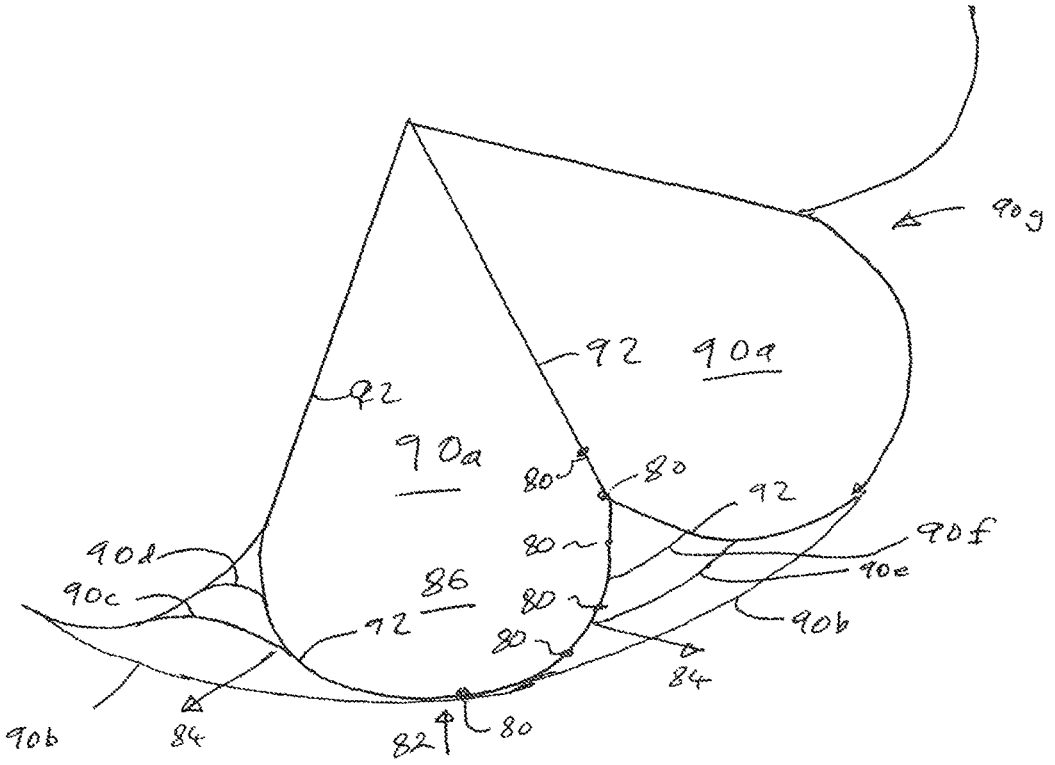

As shown in FIG. 5C, the outer rib elements 18, may have a relatively narrow width, to enable them to flex freely, so that no great force is required to open the umbrella. However, the outer rib elements 18 can be attached to the canopy 20, so that the canopy 20 serves a structural function and limits the flexing of the rib elements 18. FIG. 5D shows how the rib elements 18 may be attached at various points, indicated that 80 to the canopy 20. As indicated by the arrow 82, if a radial force is applied where the rib elements 18 join, this tends to force the rib elements 18 to bow outwards, as indicated at 84. Due to the connections at 80, this movement is resisted and a portion of the canopy 20, indicated that 86, between the rib elements 18 is put into tension. Thus, the rib elements 18 will appear to be much stiffer, and this overall arrangement can be designed to provide the necessary tension in the canopy.

Figure 5E:
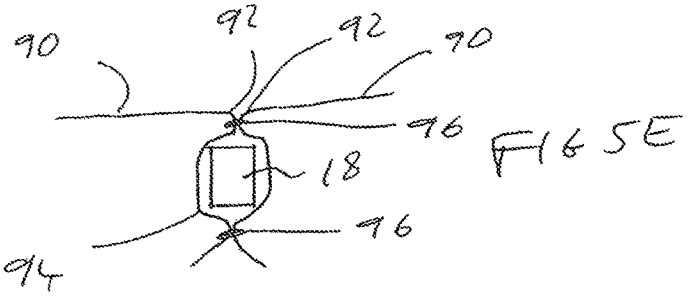

As shown in FIG. 5D, it is possible for the canopy 20 to be provided as a number of separate canopy elements 90 joined along edges 92 that follow the ribs 12 and the outer rib elements 18. As shown in FIG. 5E, it is possible for joints between the canopy elements 90, to be formed to provide elongate channels 94, that may be continuous or in segments into which the outer rib elements 18 are inserted. The canopy elements are sewn together or otherwise joined at 96. This again will enable the canopy 20 to provide a structural function and to prevent excessive flexing of the outer rib elements 18.

To accentuate the design of the frame and umbrella, different patterns or colours can be applied to the individual canopy elements 90, to emphasize that, unlike conventional umbrellas, these are not simple triangular elements These canopy elements may comprise central canopy elements 90*a*, and peripheral canopy elements 90*b*, the later being indicated by their outer periphery.

Further to accentuate the shape enabled by the new design, the canopy elements indicated at 90*b* can be omitted, or can be replaced with smaller canopy elements whose edges are set back from the main periphery of the canopy. Examples are indicated at 90*c, d, e*, and *f*, showing both different sizes and different edge peripheries (it will be understood that, while FIG. 5D shows a number of variant designs, generally just one design would be used for the whole umbrella, although it is possible to provide any combination of the different designs around the umbrella). In this case, at least part of the rib elements can be enclosed in pockets formed from edges of the canopy elements indicated at 90*b*. As noted above, tension in the canopy elements 90*a* will then effectively provide added rigidity in response to loads, e.g. impacts, at the edge of the canopy generally tending to deflect the canopy inwards towards the main shaft of the umbrella.

Where the canopy elements 90*b* are omitted entirely, indicated at 90*g*, or are quite small, the umbrella then presents a multi-lobed appearance resembling a flower.

Figure 12A:
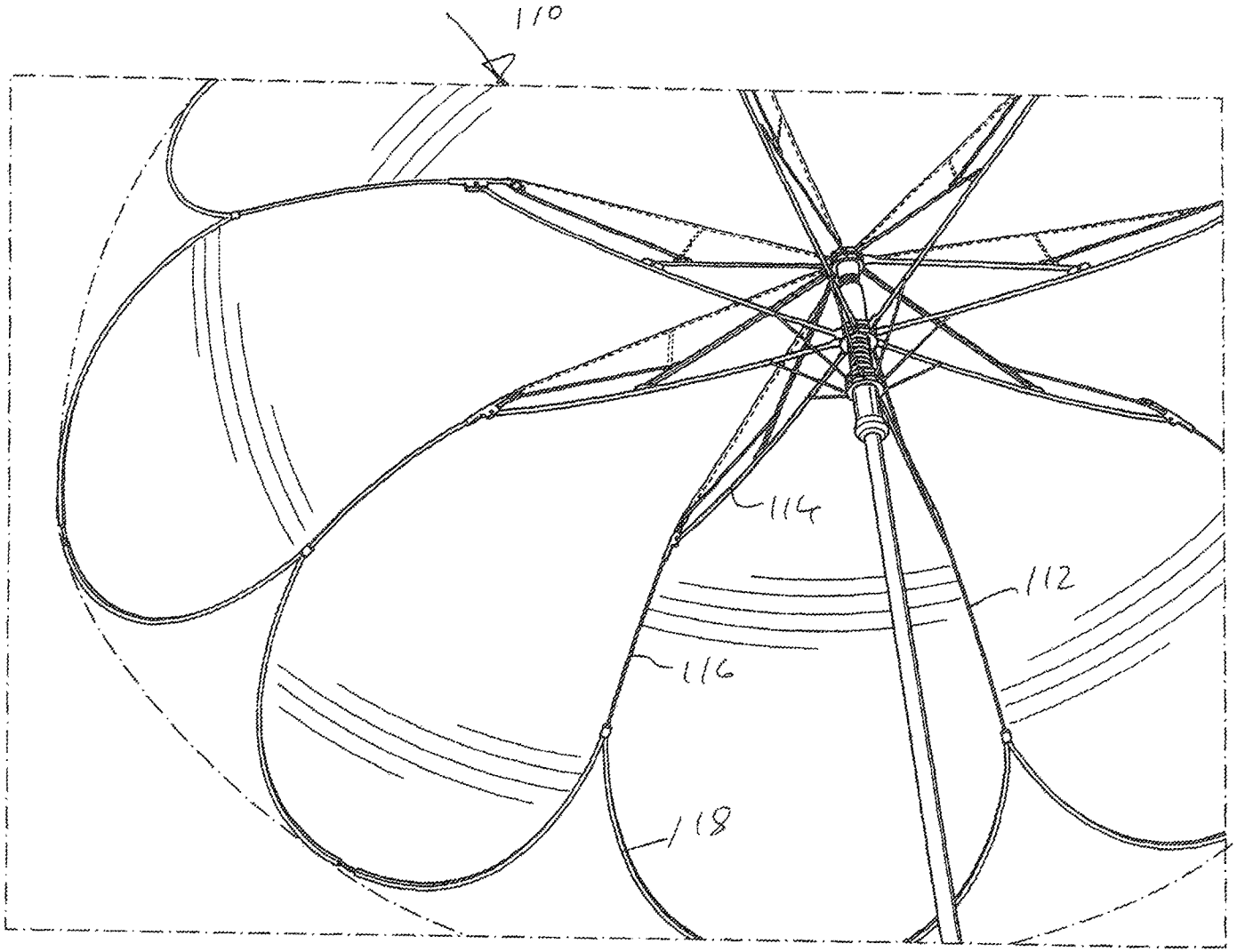
FIG. 12A a shows a perspective view of a second embodiment of an umbrella according to the present invention.
Figure 12B:
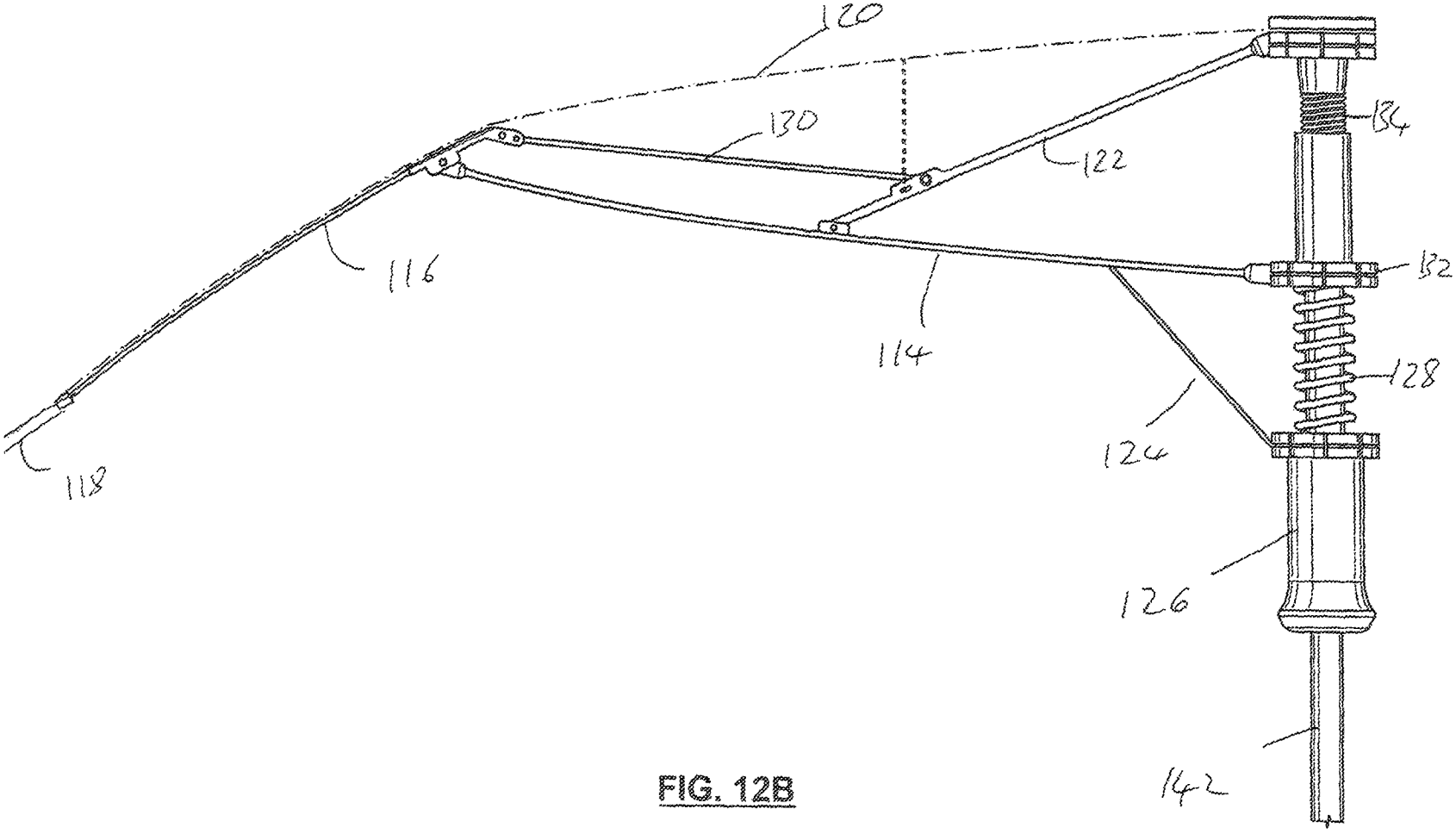
FIG. 12B shows a side view of the second embodiment.
Figure 12C:
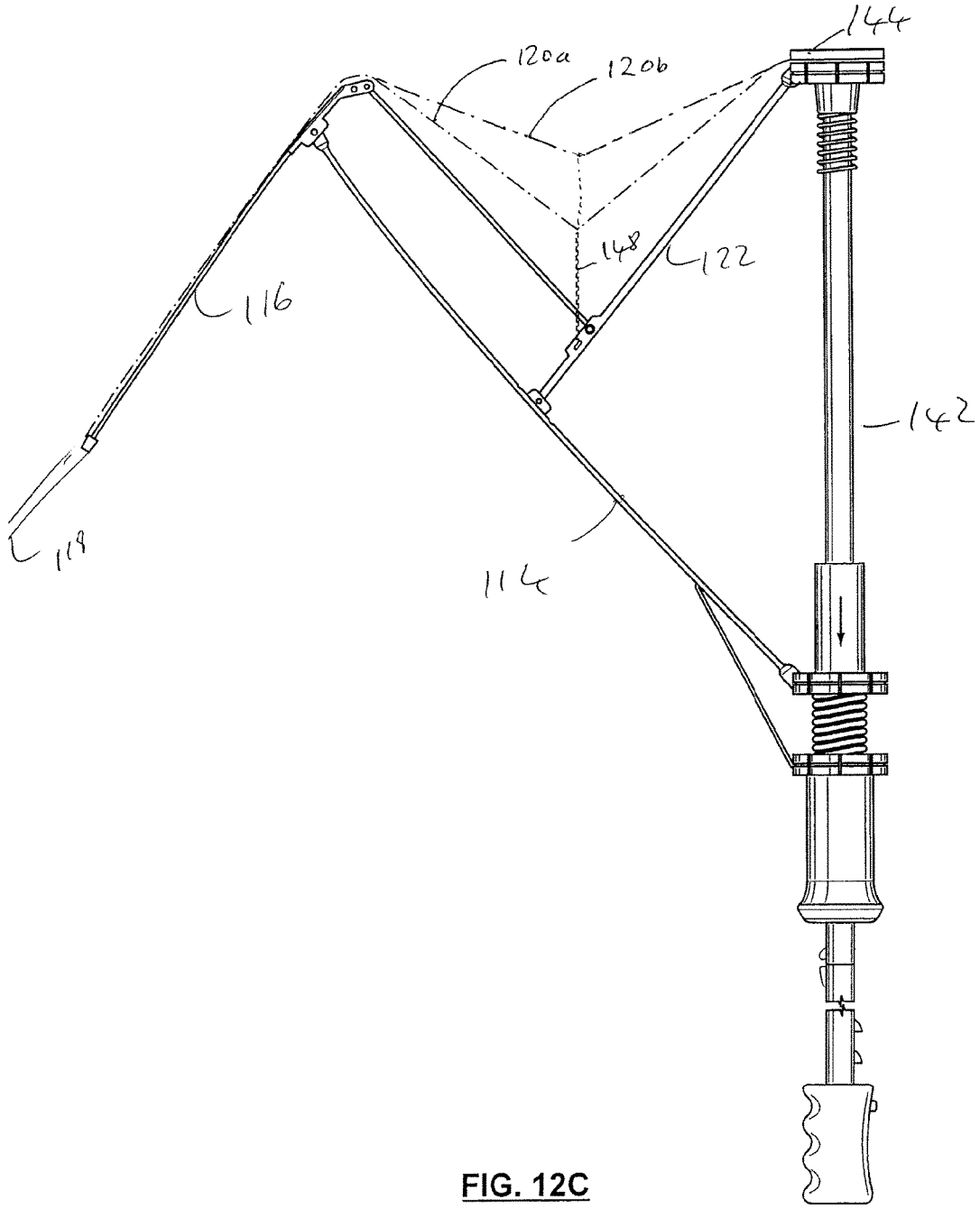
FIG. 12C shows a side view of the second embodiment in a partially closed position.

Reference will now be made to FIGS. 12A-12C, which show a collapsible or foldable umbrella according to a second embodiment of the present invention. Similar reference numerals are used as for the first embodiment, but with the suffix 100 added, for many references. Thus, the second embodiment is denoted by the reference 110, has a frame 140 and includes a main shaft 142 with the ribs 112 pivotally attached to the upper end of the shaft 142.

A first slider 126 is spaced from a second slider 132 by a spring 128, that is relatively strong and is used to effect opening of the umbrella 110. The ribs 112 have inner rib elements 114, that are pivotally attached the second slider 132. Actuation links 124 are pivotally connected to the first slider 126 and the inner rib elements 114. A comparison of FIG. 12B and FIG. 12C shows that as the umbrella 110 moves from the closed position (the partially closed position being shown in FIG. 12C) to the open position of FIG. 12B, the spring 128 is able to expand This expansion drives the umbrella from the closed to the open position.

Each inner rib element 114 is pivotally connected to a first connecting rib 122, whose other end is pivotally connected to the top of the main shaft 142. A middle rib element 116 is pivotally connected to a respective inner rib element 114, at a location spaced from the inner and thereof. The inner end of each middle rib element 116 is pivotally connected to a second connecting rib 130, whose other end is pivotally connected to the first connecting rib 122, as shown. Each middle rib element 116, as for the first embodiment, is connected to a pair of outer rib elements 118. Each outer rib element 118 has a tip or end that is connected to or otherwise maintained close to the tip or end of an outer rib element 118 of an adjacent rib 112. The various connection and mounting arrangements for the ends of ribs discussed in relation to FIGS. 5-11 are applicable to this second embodiment.

As FIG. 12B and FIG. 12C show, the Spring 128 expands and drives the sliders 126, 132 apart. The actuation links 124 pull the inner rib elements 114 down from position close to the main shaft 142, to the extended position shown in FIG. 12B. As the inner rib elements 114 move to the extended, open position, they displace ends of the first connecting ribs 122 away from the main shaft 142, effectively pulling the second slider 132 towards the top of the main shaft 142; in known manner, at the top of the main shaft 142, there is an element 144, to which the first connecting ribs 122 are pivotally connected.

As the inner rib elements 114 and the first connecting ribs 122 move towards the extended position in FIG. 12B, the second connecting ribs 130 cause the outer rib elements 118 to pivot and extend outwardly.

Between the top of the second slider 132 and the top element 144, there is a spring 134, with a relatively low spring constant. It serves to cushion motion of the second slider as it moves to the extended position of FIG. 12B.

Conventionally. a canopy or a cover 120, for such a collapsible or foldable umbrella, is attached to elements of the umbrella frame 140, to assist the canopy 120 in being maintained in a desired position and folding neatly. Thus, the canopy 120 may be attached to the ribs 112 at various locations along the middle and outer rib elements 116 and 118. Further, as indicated at 148, a connecting link for each rib 112, often a length of thread of like, is provided between the first connecting rib 122 and the canopy 120.

Figure 12D:
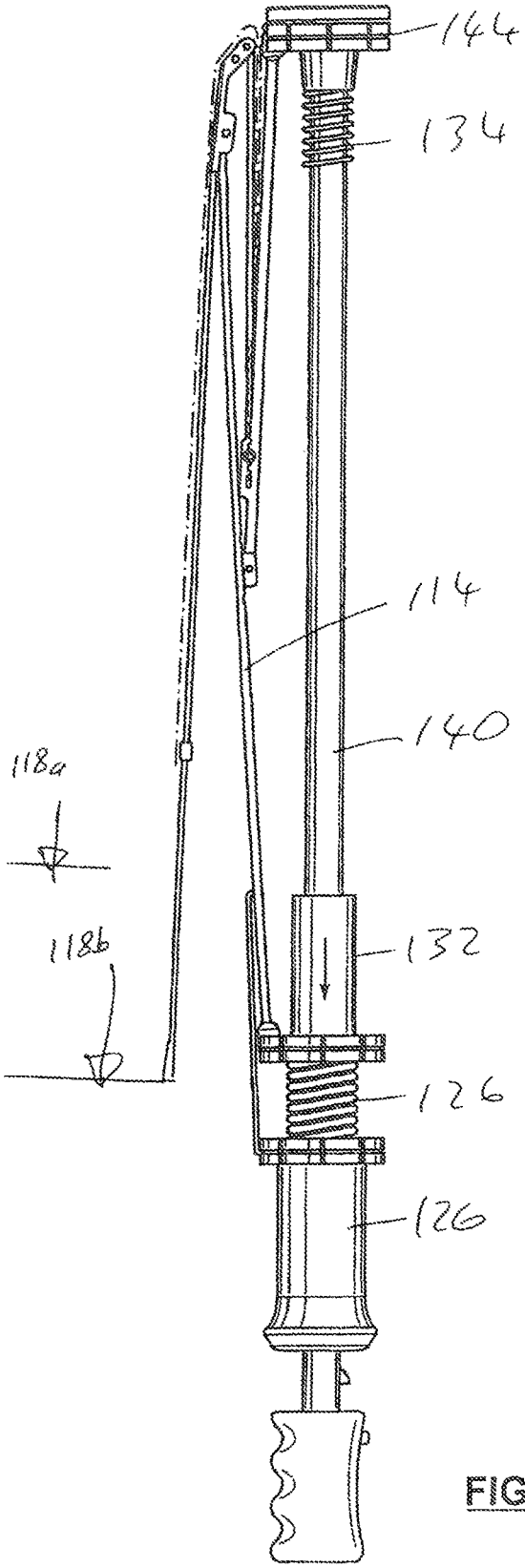
FIGS. 12D and 12E show side views of the second embodiment in the closed position.
Figure 12E:
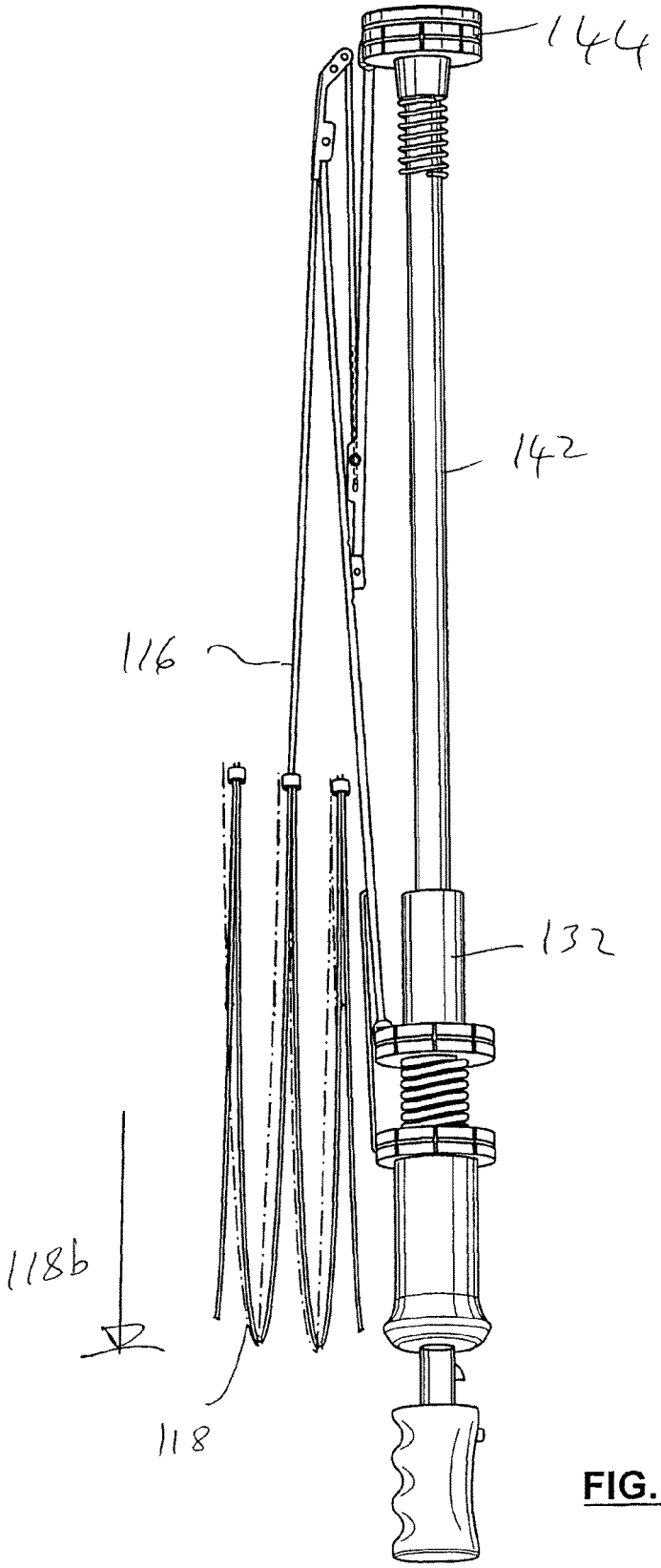

Then, as shown in FIGS. 12C and 12D, as the umbrella collapses, the connecting links 148 pull inner portions of the canopy 20 downwards.

In the present invention, as for the first embodiment, the flexing of the outer rib elements 118 has the effect of increasing the radius, measured from the centre line axis of the main shaft 142, from the extended or open position of FIG. 12B to the collapsed or folded position, shown in FIG. 12D. FIG. 12D shows at 118*a* the extent of the outer ribs 118 in the open configuration, and at 118*b* at the greater extent of the outer ribs 118 in the folded or collapsed configuration. The consequence of this is that the fold shown at 120*a* for the cover, occurring in a conventional umbrella, may not occur or will be much less. Rather, as the umbrella moves to the folded configuration and the outer rib elements 118 straighten and extend, the canopy 120, adjacent to the main shaft 142, may extend somewhat as shown at 120*b*.

Put another way, it has been realized that the characteristics of a folding or collapsible umbrella can be used to accommodate the extension of the outer rib elements 118 in the folded configuration. By suitably dimensioning the elements of the frame 140, and choosing a suitable number of ribs 112, it should be possible to accommodate all of this extension, without having to provide the sliding arrangement to give variable rib length, as in the first embodiment.

While the canopy 120 may still be attached to the middle and outer rib elements 116 and 118, such attachment may need to accommodate relative movement between the canopy 120 and those rib elements. Thus, the canopy 120 will slide over the inner ends of the middle rib elements 116, as the umbrella is opened and closed. The middle rib elements 116, at least at their inner ends, may be provided with a finish or components providing for free sliding of the canopy 120. Instead of the fixed connecting links 148, these may be omitted or replaced with links of a different length or elastic links.

For both embodiment of the present invention, these may be applied to asymmetric umbrellas, such as that described in WO2006/1132525. In this case, the angles between the ribs 12 or 112 may be made unequal. The angles between the longer ribs can be smaller than the angles between the shorter ribs. These angles can be selected so that the effect of the outer rib elements giving an extension as they straighten out from their flexed shape can be more or less equalized for the different rib lengths. This property of unequal angles is another general aspect of the present invention applicable to the design of WO2006/132525, with conventional straight and independent ribs.

All the patents and patent applications disclosed herein are hereby incorporated by reference, without any admission that these documents constitute prior art.

While the invention has been described in various embodiments, various alternatives are possible, and modifications and additions may be made without departing from the scope of the present invention. For example, while the ends of pairs of outer rib elements from adjacent ribs may be connected together at their outer ends, this is not essential. Such a connection results in each outer rib element extending to a point that half of the circumferential distance between the ribs. Alternatively, the outer rib elements can extend to a position that is less, e.g. only ⅓, ¼, or ⅕ of the the circumferential distance between the ribs. Then the ends of the outer rib elements would be individually attached or connected to the periphery of the canopy, e.g. by a sewn connection or by being received in a pocket of the canopy. As the outer elements still provide the flexing action and the effective change in radius detailed above, the mechanism of the frame may have to be dimensioned to accommodate this.

The invention claimed is:

1. A frame for an umbrella for supporting a canopy, the frame comprising: a main shaft; a plurality of ribs connected to the main shaft, each rib including, a pair of outer rib elements and being movable between open position and closed position, with an outer end of each outer rib element being connected to the outer end of the outer rib element of an adjacent rib, and being adapted to be attached to the periphery of the umbrella canopy, wherein at least one of the depth and the width of each outer rib element tapers from a larger dimension at an inner end thereof to a smaller dimension at an outer end thereof, and wherein each of the outer rib elements along the length thereof has a first bending resistance in a direction generally perpendicular to the canopy in use, and along the length thereof a second bending resistance in a second direction perpendicular to the first direction, wherein the first bending resistance is greater than the second bending resistance along the length thereof.

2. A frame as claimed in claim 1, wherein the free ends of the outer rib elements are connected together by one of a pivot connection and a living hinge.

3. A frame as claimed in claim 2, wherein said one of a pivot connection and a living hinge includes an opening, for attaching the frame to the canopy by thread.

4. A frame as claimed in claim 1, wherein each outer rib element optionally has one of a rectangular and elliptical cross-section.

5. A frame as claimed in claim 4, wherein each rib includes a middle rib element and the outer rib elements are attached to the middle rib elements such that each outer rib element, in an open position of the frame, forms a shallow V-shape with an adjacent outer rib element of another rib.

6. A frame as claimed in claim 1, wherein each rib comprises an inner rib element, a middle rib element pivotally connected thereto, and said pair of outer rib elements connected to the middle rib element, and a mechanism for causing the inner and middle rib elements to move between an extended position and a closed position.

7. A frame as claimed in claim 6, wherein, for each rib, the inner rib element is connected to a second slider on the main shaft, a first slider is mounted on the main shaft below the second slider, an actuation link pivotally connects the first slider to the inner rib element, and an actuation spring is provided between the first and second sliders.

8. A frame as claimed in claim 7, wherein, for each rib, a first connecting rib is pivotally connected between the main shaft and the corresponding inner rib element, and a second connecting rib is pivotally connected between the first connecting rib and the corresponding middle rib element.

9. A rib structure for an umbrella or the like, comprising an inner rib element, and a pair of outer rib elements, that are flexible, for adopting a straight configuration in a closed configuration of an umbrella and being capable of flexing for an open position of an umbrella, wherein the outer rib elements, along the length thereof, have non-uniform cross-sections, and wherein each outer rib element, along the length thereof provides for a first bending resistance to movement generally circumferentially in an open configuration of an umbrella, and a second bending resistance along the length thereof generally perpendicular to the canopy of an umbrella that is greater than the first bending resistance along the length thereof, and wherein at least one of the depth and the width of each outer rib element tapers from a larger dimension at an inner end thereof to a smaller dimension at an outer end thereof.

* * * * *